US005078284A

United States Patent [19]

Pirkl et al.

[11] Patent Number: 5,078,284

[45] Date of Patent: Jan. 7, 1992

[54] PORTABLE DISPLAY PLATFORM

[75] Inventors: Paul M. Pirkl, Burnsville; Gary R. Sorenson, Apple Valley; Wesley W. Jones, Lakeville, all of Minn.

[73] Assignee: Skyline Displays, Inc., Burnsville, Minn.

[21] Appl. No.: 586,813

[22] Filed: Sep. 24, 1990

[51] Int. Cl.[5] ..... A47B 47/00

[52] U.S. Cl. ..... 211/198; 211/195

[58] Field of Search ..... 211/198, 195, 149, 132, 211/104, 85; 248/150, 166

[56] References Cited

U.S. PATENT DOCUMENTS

| | | | |
|---|---|---|---|
| 255,215 | 3/1882 | Tuttle | 211/195 |
| 631,948 | 8/1899 | Bush | 211/195 X |
| 1,095,814 | 5/1914 | Champion | 211/195 X |
| 1,158,212 | 10/1915 | Henderson | 211/149 X |
| 1,714,698 | 5/1929 | Stoll | 211/195 X |
| 2,784,004 | 3/1957 | Hamrich, Jr. | 211/149 X |
| 4,727,994 | 3/1988 | Beaulieu | 211/198 |
| 4,926,294 | 5/1990 | Beaulieu et al. | 362/125 |

FOREIGN PATENT DOCUMENTS

| | | | |
|---|---|---|---|
| 13840 | of 1912 | United Kingdom | 211/195 |

*Primary Examiner*—Karen J. Chotkowski

*Attorney, Agent, or Firm*—Palmatier & Sjoquist

[57] ABSTRACT

A platform frame assembly for attachment to a portable exhibit display, the platform frame assembly having pivotal display frame members which are engageable against the portable exhibit display in an interlocking arrangement; the platform frame assembly having a plurality of horizontal shelves supportable by the frames for providing a projecting platform as an attachment to the portable exhibit display.

7 Claims, 3 Drawing Sheets

PORTABLE DISPLAY PLATFORM

BACKGROUND OF THE INVENTION

The present invention relates to portable exhibit display structures, and more particularly to an improvement to the portable exhibit display structure which is disclosed in U.S. Pat. No. 4,727,994, issued Mar. 1, 1988.

The foregoing United States patent discloses a portable exhibit display structure which may be compactly stored into a relatively flat package, and which may be unfolded and extended to form a display panel having a plurality of vertical sections, and a sloping bottom section, all of which are supported upon at least two horizontally disposed feet. The foregoing patent also discloses a construction whereby a plurality of foldable exhibit display structures may be aligned in side-by-side relationship, to form an extended-width display structure comprising any number of sections.

An improvement to the foregoing United States patent is disclosed in copending United States patent application Ser. No. 419,498, filed Oct. 10, 1989, now U.S. Pat. No. 4,926,294 entitled "Portable Exhibit Display Header." This improvement reveals a box-like display header mountable on an upper portion of the display frame of the patent, and which is collapsible to a flat orientation to maintain an overall flat structure for storage.

Reference is made to both of these prior disclosures for evidence of prior patents which show the state of the art in this field; the present invention representing a further advance and improvement in utility to the basic display frame structure previously disclosed.

SUMMARY OF THE INVENTION

A portable display platform which is foldable into a flat package for storage and transport, and which may be unfolded and attached to a display frame of the type disclosed in U.S. Pat. No. 4,727,994, including a lower floor channel which may be horizontally aligned and attached to the foot segment of the display structure, at least a pair of vertical front frame members which are hinged to the floor channel, and at least a pair of top horizontal supports which are hingedly connected to the vertical frame members, and which may be detachably connected to the portable exhibit display. One or more shelf surfaces may be nested between the top horizontal supports to form a top support shelf, and a plurality of such foldable frames and support shelves may be aligned in side-by-side relationship to form a platform surface extending across the plurality of portable display structures previously disclosed. Flexible plastic panels may be attachable around the exterior portions of the frame members, to provide a platform over an enclosed frame structure.

The principal object and advantage of the present invention is to provide an enhanced utility for the portable and collapsible exhibit display structure previously disclosed.

A further object and advantage of the present invention is to provide a horizontal platform surface as an enhancement to the portable exhibit display structure previously disclosed, for improving the utility and appearance of the aforementioned portable exhibit display.

Another object and advantage of the present invention is to provide a horizontal platform which is removably attachable to a portable exhibit display structure, and which may be foldable into a flat form for storage and transport.

The foregoing and other advantages and objects of the invention will become apparent from the following specification and claims, and with reference to the appended drawings.

DESCRIPTION OF THE PREFERRED EMBODIMENT

Figure 1:
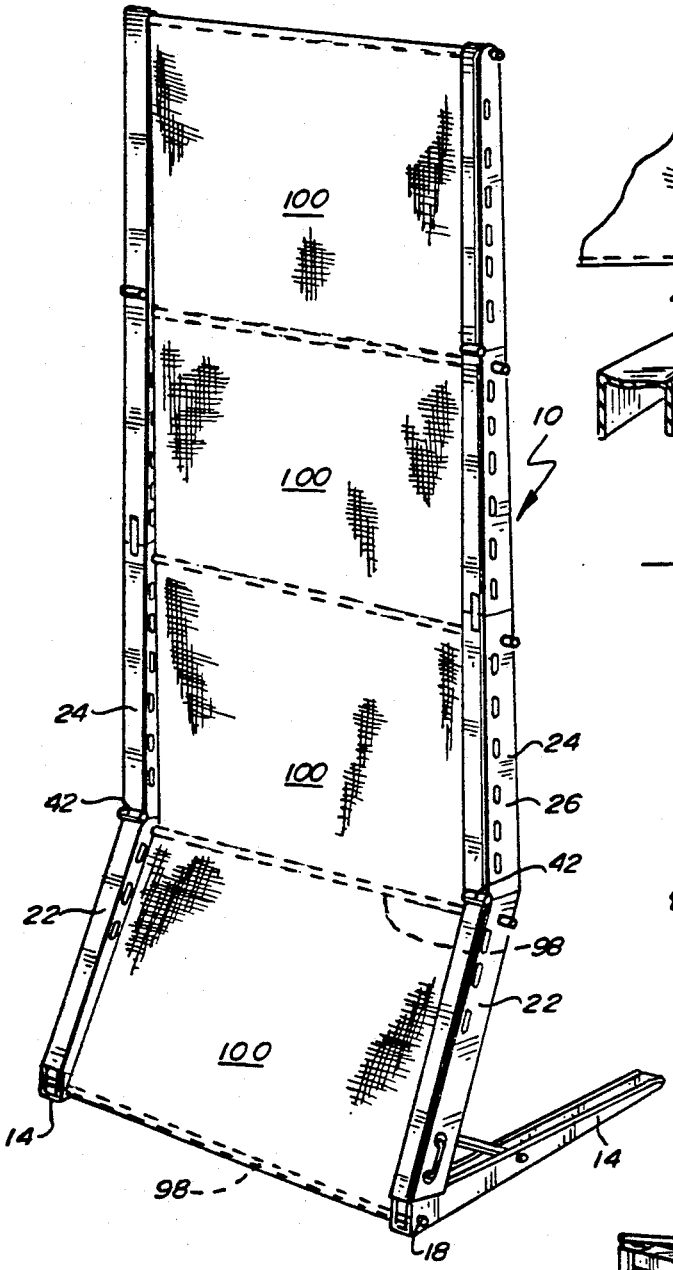
FIG. 1 shows a portable exhibit structure adaptable for use with the present invention.

Referring first to FIG. 1, there is shown one form of the collapsible support and attachment structure disclosed in U.S. Pat. 4,727,994. The portable exhibit display 10 formed by this structure includes a plurality of panels 100, which may typically be made from fabric or similar material. A plurality of rods 98 extend between hinged brace members to support the structure and the panels 100. The display panel is supported on a pair of horizontal feet 14, which are hingedly connected to a pair of inclined braces 22. The inclined braces are hingedly connected to a plurality of pairs of vertical braces 24. The rods 98 bridge between the respective side braces, and all of the braces have a plurality of elongated slots 26 arranged along their respective edges. A pair of pins 18 extend through the channels which form horizontal feet 14, in a manner to be hereinafter described; pins 18 may be formed by an extension of rod 98.

Figure 2:
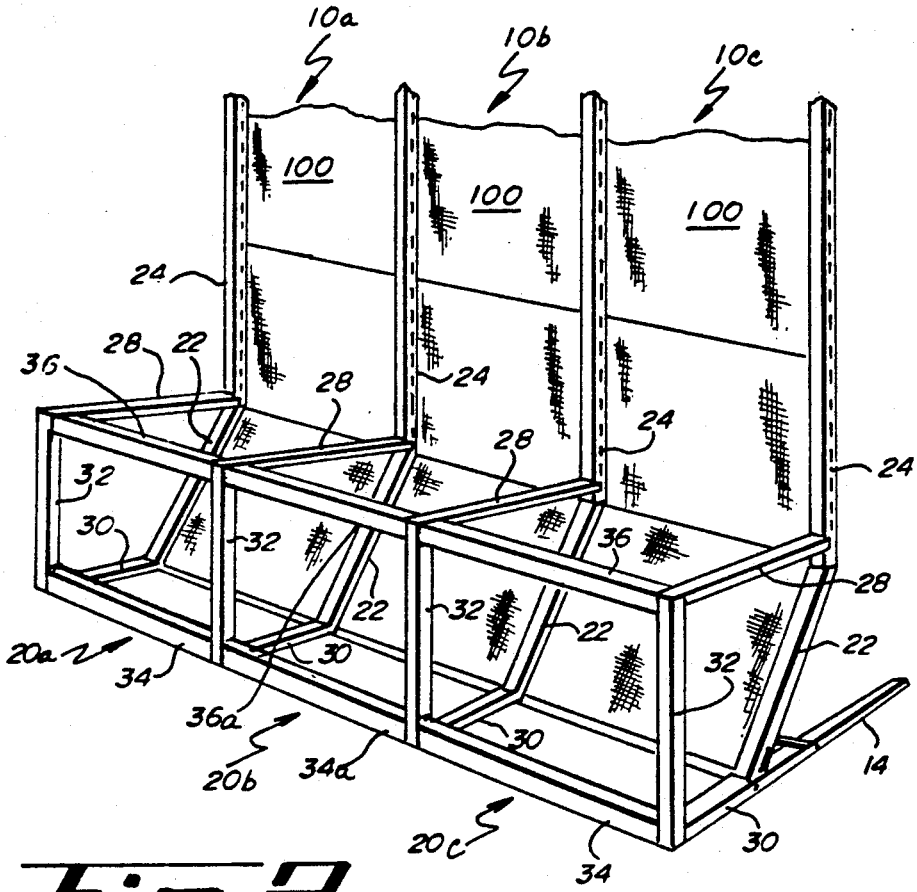
FIG. 2 shows the invention in one of its forms attachable to portable exhibit displays.

Referring next to FIG. 2, a plurality of portable exhibit display structures 10 are shown in side-by-side alignment, wherein display structures **10*a* and 10*c* are the same structures as are shown in FIG. 1, and display structure 10*b* is formed by merely bridging panels 100 between the support braces and vertical frame members which comprise the interior sides of frames 10*a* and 10*c*. A plurality of platform frame assemblies are attached to the portable exhibit display structures, platform frame assembly 20*a* being attached to exhibit frame 10*a*, platform frame assembly 20*c* being attached to exhibit frame 10*c*, and platform frame assembly 20*b* being formed by interconnecting platform frame assemblies 20*a* and 20*c* in a manner to be hereinafter described. Each of the platform frame assemblies 20*a* and 20*c* has a pair of top horizontal supports 28 which are attachable to a vertical frame brace 24. Each of the platform frame assemblies 20*a* and 20*c* has a floor channel 30 which is attachable to a horizontal foot 14 of portable exhibit frame 10. Each of the platform frame assemblies 20*a* and 20*c* has vertical supports 32 which extend between floor or lower channels 30 and top or upper horizontal supports 28**. Each of the platform frame assemblies 20*a* and 20*c* has a bottom transverse horizontal support bar 34 and a top transverse horizontal support bar 36 between respective vertical supports 32. Platform frame assembly 20*b* is formed by attaching a bottom transverse horizontal support bar 34 and a top transverse horizontal support bar 36 between respective vertical supports 32 of assemblies 20*a* and 20*c*.

Figure 3:
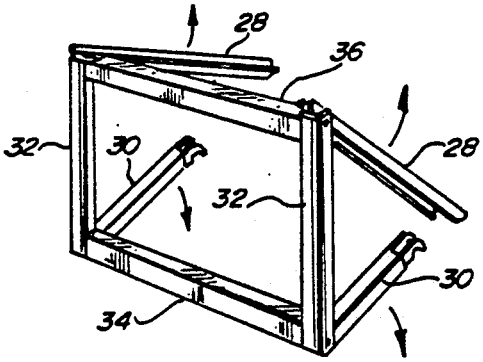
FIG. 3 shows the invention in partially open position.

FIG. 3 shows a platform frame assembly 20*a* or 20*c* in partially open position, to illustrate that floor channels 30 and top horizontal supports 28 are each pivotally mounted to a vertical support 32. Floor channels are sized to pivotally nest within the U-channel formed by a vertical support 32, and top horizontal supports 28 are similarly sized to nest within a vertical support 32, thereby to enable folding of the floor channels 30 and the top horizontal supports 28 completely into recessed position within vertical support 32. Floor channels 30 and top horizontal supports 28 may be unfolded in the direction indicated by the arrows to assemble the platform frame assembly.

Figure 4:
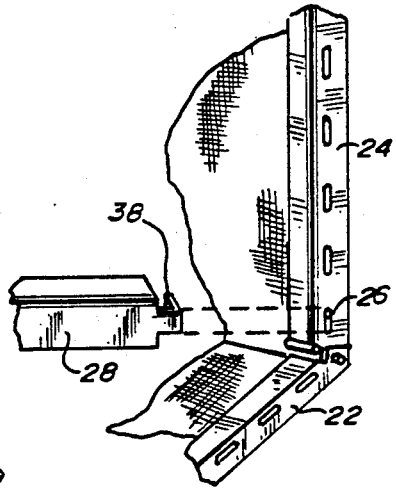
FIG. 4 shows one connection feature of the invention.

FIG. 4 shows the interconnection of a top horizontal support 28 with a vertical brace 24 of portable exhibit display 10. Top horizontal support 28 has a projecting tab 38 which is bent into a right angle bend, and is inserted into one of the elongated slots 26 along vertical brace 24. Preferably, the insertion is made into the bottom-most elongated slot 26, immediately above the hinged connection to inclined brace 22.

Figure 5:
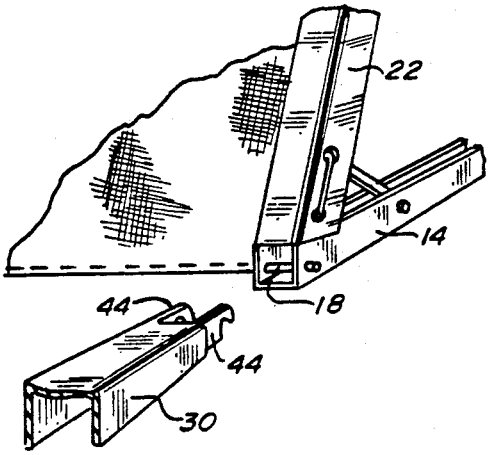
FIG. 5 shows a second connection feature of the invention.

FIG. 5 shows the interconnection of a floor channel 30 with an exhibit display frame 10. Floor channel 30 has a pair of projecting hooked tabs 44 which may be fitted about pin 18 on horizontal foot 14. The hooking of tabs 44 about pin 18 interconnects the end of floor channel 30 to the front of horizontal foot 14.

Figure 6:
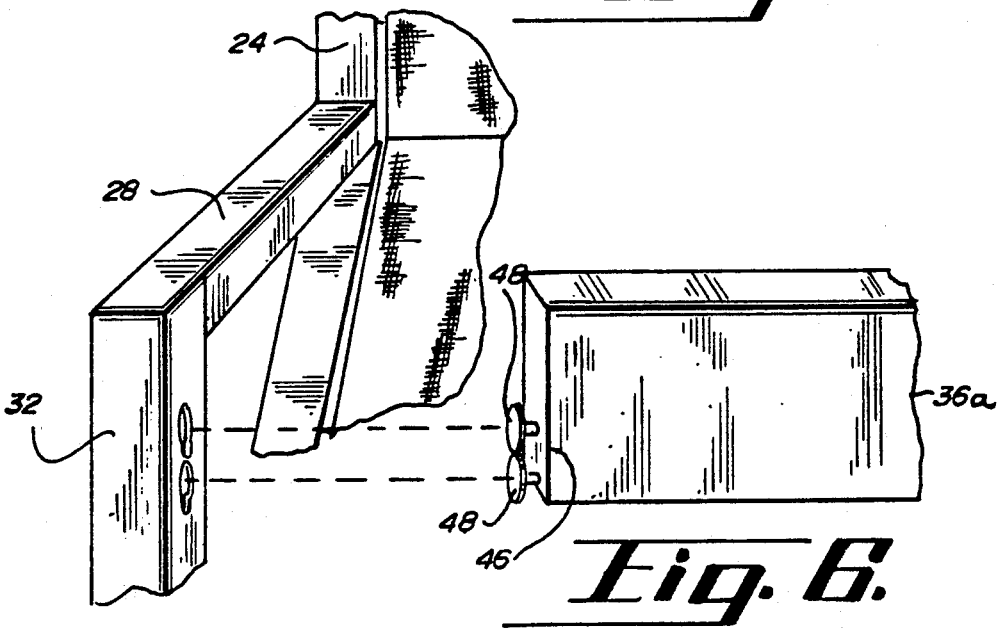
FIG. 6 shows a third connection feature of the invention.

FIG. 6 shows the interconnection of a top support bar 36*a* with a vertical support 32, to form the center platform frame assembly 20*b*. Top support bar 36*a* has a pair of projecting pins 48 having enlarged heads. The respective channels which form vertical support 32 have elongated holes positioned to match pins 48, so that pins 48 may be inserted into the elongated holes and top support bar 36*a* may be moved downwardly to interlock the enlarged heads into corresponding narrow portions of the elongated holes. This engagement and interlocking connection is of conventional and well-known design, and a similar connection structure exists for bottom support bar 34*a*.

Figure 7:
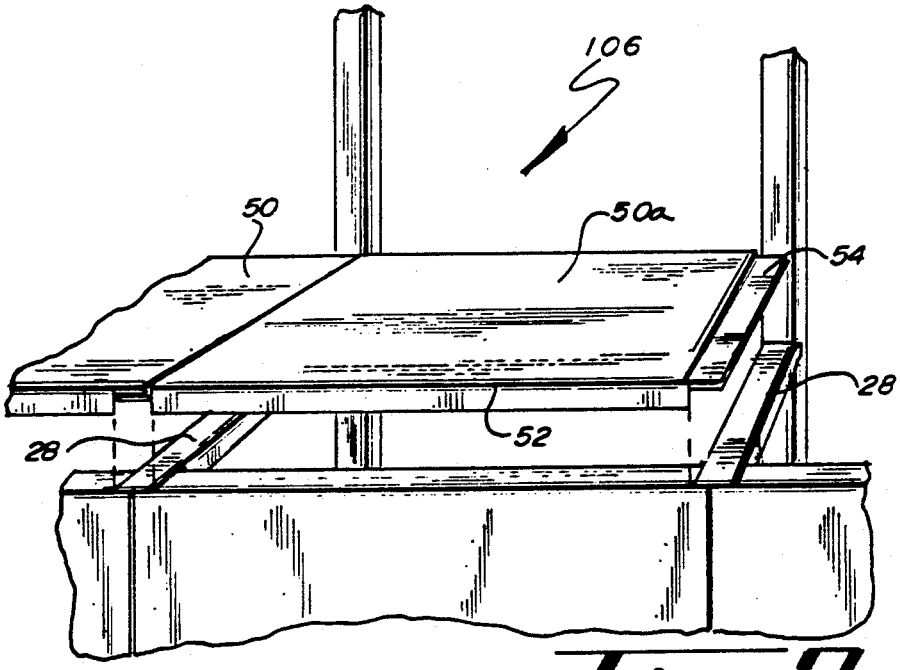
FIG. 7 shows a support shelf in relation to the invention.

FIG. 7 shows a shelf 50*a* which may be nested between two top horizontal supports 28. Shelf 50*a* has a downwardly directed lower edge 52 which is sized to nest between top horizontal supports 28. Shelf 50*a* also has horizontal edges 54 which rest atop top horizontal supports 28. Edges 54 are formed slightly differently for the shelf 50*a* which is used to bridge the center display 10*b*. In this section, edges 54 are slightly offset below the planar surface of shelf 50*a*, so as to provide a slight offset to accommodate the thickness of the corresponding edges 54 of adjacent shelves 50. The shelves 50 utilized in portable display sections 10*a* and 10*c* also have horizontal edges 54, but these horizontal edges extend outwardly without being offset, so that a smooth top surface may be formed when the plurality of sections are combined.

Figure 8:
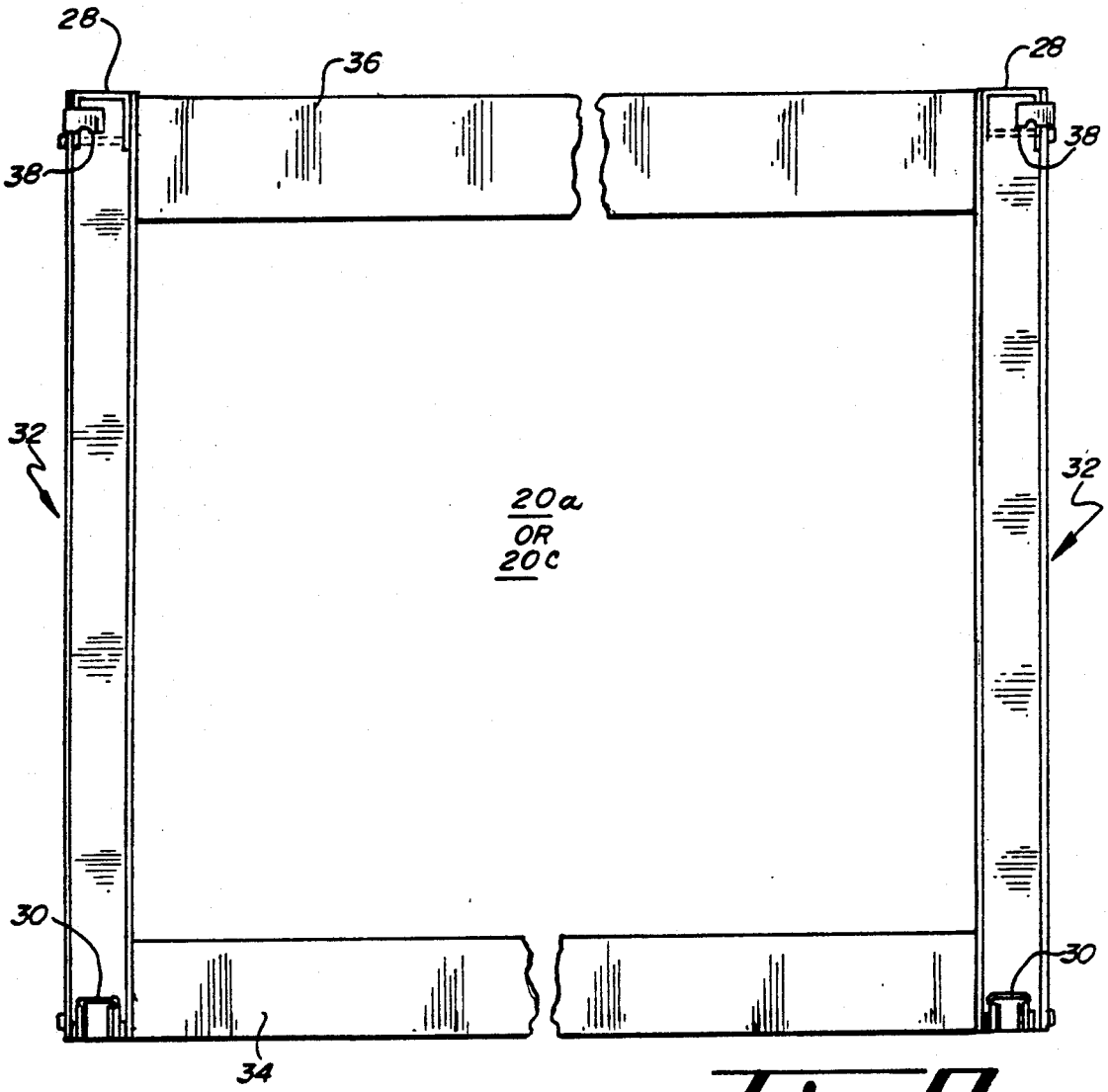
FIG. 8 shows a rear elevation view of the invention in erected form.

Referring to FIG. 8, a rear elevation view is shown of platform frame assembly 20, to illustrate the foldable nesting feature of the invention. Floor channel 30 is sized to be considerably more narrow than the channel walls of vertical support 32, so that when floor channel 30 is folded inwardly it completely nests within the walls of vertical support 32, leaving additional space between the respective channel walls. Top horizontal support 28 has correspondingly wider channel walls, albeit still narrower than the width of vertical support 32. When top channel 28 is pivotally recessed to nest within vertical support 32, it is sufficiently wide to permit the nesting of floor channel 30 within its inner dimensions. The length of top horizontal support 28 is made sufficiently long so that, in its folded position, the inwardly bent tabs 38 extend beyond the lower ends of floor channels 30.

In operation, the platform frame assembly 20 may be folded into completely flat configuration for storage and transport. During assembly, floor channels 30 and top horizontal supports 28 are respectively pivoted outwardly from their nested positions to align with their connections to portable exhibit display 10. The hooked tabs of floor channel 30 are engaged about pin 18 at the end of horizontal foot 14, and the tabs 38 of top horizontal support 28 are engaged into respective elongated sots in portable display 10. The top and bottom support bars 36*a* and 34*a* are locked between vertical channels 32 to form assembly 20*b*. The shelves 50 are then inserted into position between adjacent top horizontal supports, to complete the assembly operation. If desired, a plurality of outer panels may be incorporated with the invention to provide a covering about the frame members which comprise platform frame assembly 20. One form of plastic panel covering which has been used with the invention utilizes plastic panels appropriately sized to fit against the respective frame members, wherein magnetic strip attachments are used to adhere the panels to the frame members. When utilized in this form, the platform frame assemblies appear as completely enclosed frame assemblies, which greatly enhance the utility and appearance of a portable exhibit display 10. When a plurality of platform frame assemblies are utilized in side-by-side alignment, as is illustrated in FIG. 2, the intermediate platform frame assemblies are merely formed by a pair of support bars, as for example, a single top support bar 36*a* and a single bottom support bar 34*a*, which may be engaged against respective vertical supports 32 by the pin and slot construction previously described. Any number of platform frame assemblies may be interconnected in side-by-side relation, utilizing the techniques and structures disclosed herein.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A portable display platform mountable to a lower portion of a display structure disposed on a surface, the platform being foldable into a flat package for storage and transport, the platform comprising:

a) at least a pair of lower supports, each support having a proximal end including means for detachably connecting to said display structure, and a distal end extending away from said display structure, said lower supports being bearable on said surface;

b) at least a pair of upper supports, each support having a proximal end including means for detachably connecting to said display structure, and a distal end extending away from said display structure;

c) a vertical support hingedly connected between respective distal ends of each of said lower and upper supports, said vertical support being formed as a U-channel having a width between its sidewalls greater than the width of either said connected lower support and said connected upper support;

d) a plurality of transverse supports, each of said transverse supports bridging between respective adjacent vertical supports; and e) including a collapsed position and an in-use position wherein the collapsed position comprises the upper and lower supports nested within each other and being nested in the vertical support, and wherein the in-use position comprises the upper and lower supports being disposed parallel to each other and being disposed generally perpendicularly to the vertical support.

2. The apparatus of claim 1, wherein each of the lower supports is shorter than each of the vertical supports so that the lower supports are substantially completely nestable in their respective vertical supports.

3. The apparatus of claim 1, wherein each of the upper supports is longer than each of the vertical supports so that portions of the upper supports extend from their respective vertical supports when the elongate portions of the upper supports are nested in their respective vertical supports.

4. The apparatus of claim 1, wherein each of the proximal ends of the lower and upper supports are connectable to the lower portion of the display structure.

5. The apparatus of claim 1, and further comprising a shelf mountable on and between adjacent upper supports.

6. The apparatus of claim 1, wherein each of the upper, lower, and vertical supports comprises a U-channel member.

7. The apparatus of claim 6, wherein the width of each of the upper supports is greater than the width of its respective lower support.

* * * * *